US009946214B2

(12) United States Patent
Kinoshita

(10) Patent No.: US 9,946,214 B2
(45) Date of Patent: Apr. 17, 2018

(54) CONTROL OF AN ENVIRONMENT HEATER IN AN IMAGING FORMING APPARATUS

(71) Applicant: CANON KABUSHIKI KAISHA, Tokyo (JP)

(72) Inventor: Takeshi Kinoshita, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/240,770

(22) Filed: Aug. 18, 2016

(65) Prior Publication Data

US 2017/0068203 A1 Mar. 9, 2017

(30) Foreign Application Priority Data

Sep. 8, 2015 (JP) ..... 2015-176856

(51) Int. Cl.
*G03G 15/00* (2006.01)
*G03G 21/20* (2006.01)

(52) U.S. Cl.
CPC ..... *G03G 15/80* (2013.01); *G03G 21/20* (2013.01); *G03G 21/203* (2013.01)

(58) Field of Classification Search
CPC ..... G03G 15/80; G03G 21/20; G03G 21/203
See application file for complete search history.

(56) References Cited

U.S. PATENT DOCUMENTS 5,325,209 A * 6/1994 Manabe ..... G03G 15/221 358/425
7,212,759 B2 * 5/2007 Kishi ..... G03G 15/2039 399/67
2007/0059016 A1 * 3/2007 Sato ..... G03G 15/80 399/88
2009/0067868 A1 * 3/2009 Arizumi ..... G03G 15/20 399/67
2013/0251385 A1 * 9/2013 Mitourida ..... G03G 21/206 399/44
2015/0110508 A1 * 4/2015 Nishi ..... G03G 15/5004 399/44

FOREIGN PATENT DOCUMENTS

JP 2002215006 A * 7/2002
JP 2009-216827 A 9/2009

* cited by examiner

*Primary Examiner* — David M Gray
*Assistant Examiner* — Laura Roth
(74) *Attorney, Agent, or Firm* — Canon U.S.A., Inc. IP Division

(57) ABSTRACT

In an image forming apparatus, a DC heater is provided in an image forming unit and AC heaters are provided in a sheet feed unit and an image reading unit. An environmental switch is provided at a power supply line connected to the AC heaters. A switch state detection circuit detects whether the environmental switch has been turned on. In accordance with a detection signal output by the switch state detection circuit, the supply of power to the DC heater is started.

18 Claims, 8 Drawing Sheets

CONTROL OF AN ENVIRONMENT HEATER IN AN IMAGING FORMING APPARATUS

BACKGROUND

Field

The present invention relates to control of an environmental heater in an image forming apparatus.

Description of the Related Art

In an image forming apparatus including an electrophotographic process, a defective image is sometimes created due to condensation caused by an environmental change such as a decrease in temperature during night hours or early morning hours in a certain season in a certain region or the rapid increase in room temperature caused by air conditioning after the start of a business day in an office environment.

In the field, installing an environmental heater in an image forming apparatus by a serviceman based on the serviceman's determination or in response to a user's request, can result in a configuration where condensation is prevented. The environmental heater can be manually switched on and off. Such an environmental heater can be an AC heater that uses an AC power supply (see Japanese Patent Laid-Open No. 2009-216827).

In recent years, there have been demands for the further stabilization of image quality and for further increase in the lifetime of image forming apparatuses. In order to help meet these demands, further stabilization of a temperature around a photosensitive drum in an electrophotographic process has been proposed.

While the environmental heater disclosed in Japanese Patent Laid-Open No. 2009-216827 can respond to variations in rated values of commercial AC power supplies in various sales areas, it cannot respond to variations in voltages of commercial AC power supplies. Because of the variations in voltages of commercial AC power supplies, the amount of heat generation of an AC heater varies, and it is difficult to suppress an associated temperature ripple. In order to address this, a method has been proposed that employs, as an environmental heater, a DC heater using a DC power supply produced from a commercial AC power supply instead of an AC heater.

The operation of an environmental heater in a power save mode in which an image forming apparatus does not operate is particularly effective. However, in a case where a plurality of DC heaters are required to be located as environmental heaters and are connected to a power supply for a control circuit that operates in the power save mode, the power consumption of a control unit increases in a mode (for example, a standby mode or an image forming mode) other than the power save mode. It is therefore necessary to employ a high-power power supply capable of outputting both the increase in the power consumption of the control unit and the total amount of power consumption of the DC heaters. This leads to the increase in the power consumption in the power save mode.

SUMMARY

The present invention provides an image forming apparatus including a direct-current power source, a first heater configured to generate heat upon application of a direct-current voltage from the direct-current power source, a second heater configured to generate heat upon application of an alternating-current voltage from a commercial AC power source, an alternating-current power supply line extending from the commercial AC power source to the second heater, a switch provided at the alternating-current power supply line, a detection unit configured to detect whether the switch is turned on or off, and a control unit configured to control power supply from the direct-current power source to the first heater in accordance with a detection signal from the detection unit.

Further features of aspects of the present invention will become apparent from the following description of exemplary embodiments with reference to the attached drawings.

BRIEF DESCRIPTION OF THE DRAWINGS

FIG. 5 is an operation timing chart after an environmental switch has been turned on.

DESCRIPTION OF THE EMBODIMENTS

An embodiment of the present invention will be described below with reference to the accompanying drawings.

Figure 1:
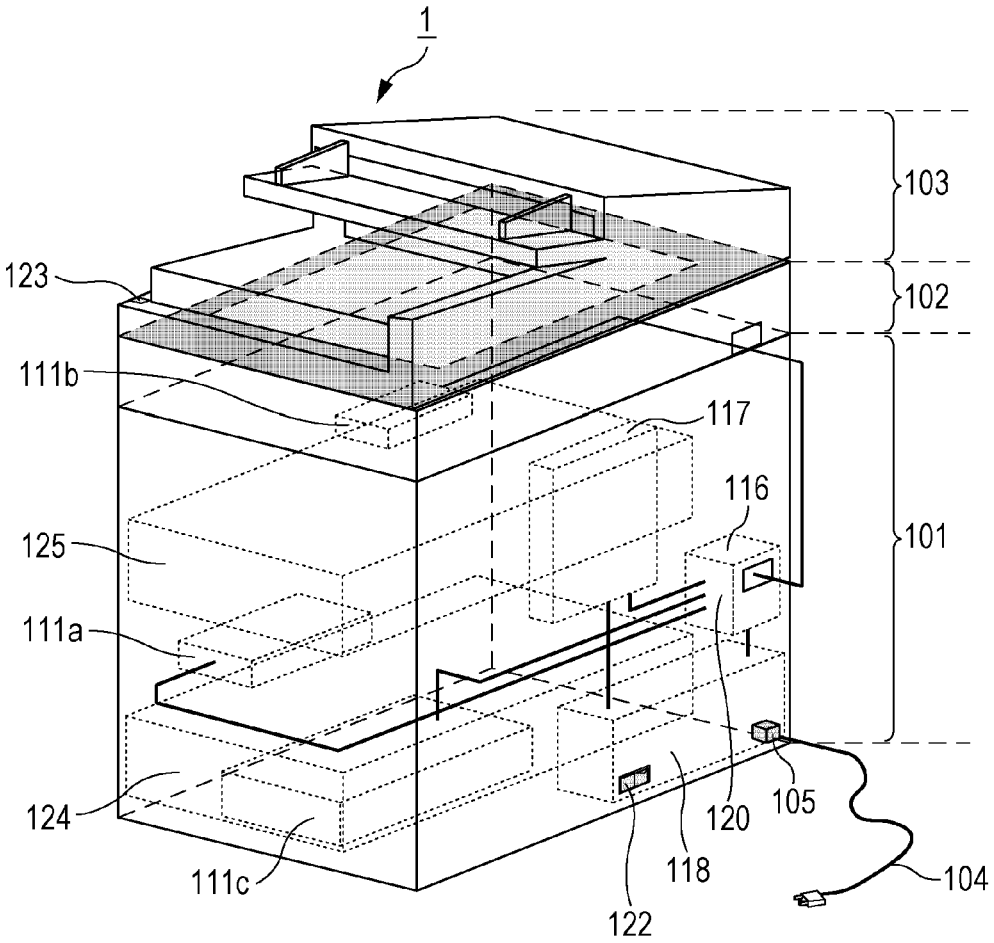
FIG. 1 is a diagram illustrating the configuration of an image forming apparatus.

FIG. 1 is a rear perspective view of an image forming apparatus according to the present embodiment. An image forming apparatus 1 includes an image engine unit 101, an image reading unit 102, and a document feeding unit 103. In the lower right portion of the back side of the image engine unit 101, an AC cord 104 for receiving power from a commercial AC power supply (a commercial AC power source) is provided. The plug shape of the AC cord 104 is based on the point of destination. Power is supplied from a commercial AC power supply to a power supply 118 in the image forming apparatus via the AC cord 104 and an inlet 105.

The image forming apparatus 1 according to the present embodiment can be switched between a normal power mode and a power save mode, which is described later. The power supply 118 includes a control circuit power supply VA 201 that operates even in the power save mode and a load driving power supply 205 (to be described in detail later) that operates in a mode other than the power save mode. When power is supplied from a commercial AC power supply to the control circuit power supply VA 201 and the load driving power supply 205, they output a direct-current voltage as DC power supplies.

The direct-current voltage is supplied to a system controller 117 and a drive load (not illustrated) such as a motor or a solenoid via a relay board 116 that is a power supply distribution unit. An image forming unit 125 is a known electrophotographic image forming unit, includes a photosensitive member, an exposure scanner, a charger, a developer, a transferer, and a cleaner, and forms a toner image to be transferred to a recording sheet fed from a sheet feed cassette 124. The system controller 117 controls the operation of the image forming apparatus 1. This will be described in detail below.

A power mode change switch 123 is used to instruct changing a mode from the normal power mode to the power save mode or from the power save mode back to the normal power mode. A user can change the power mode of the image forming apparatus by pressing the power mode change switch 123. The heaters 111*a*, 111*b*, and 111*c* are resistors having resistance values Rha, Rhb, and Rhc, respectively. The amounts of heat generation (power consumption) of the heaters 111*a*, 111*b*, and 111*c* are determined in accordance with a supplied voltage. The heater 111*a* is a DC heater that generates heat upon the application of a direct-current voltage, and the heaters 111*b* and 111*c* are AC heaters that generate heat upon the application of an alternating-current voltage.

In the present embodiment, the heater 111*a* heats a portion around the image forming unit 125 including a photosensitive member, the heater 111*b* heats the inside of the image reading unit 102, and the heater 111*c* heats a portion around the sheet feed cassette 124 accommodating recording sheets. The heaters are energized when an environmental switch 122 is turned on. The environmental switch 122 is manually operated by a user.

Figure 2:
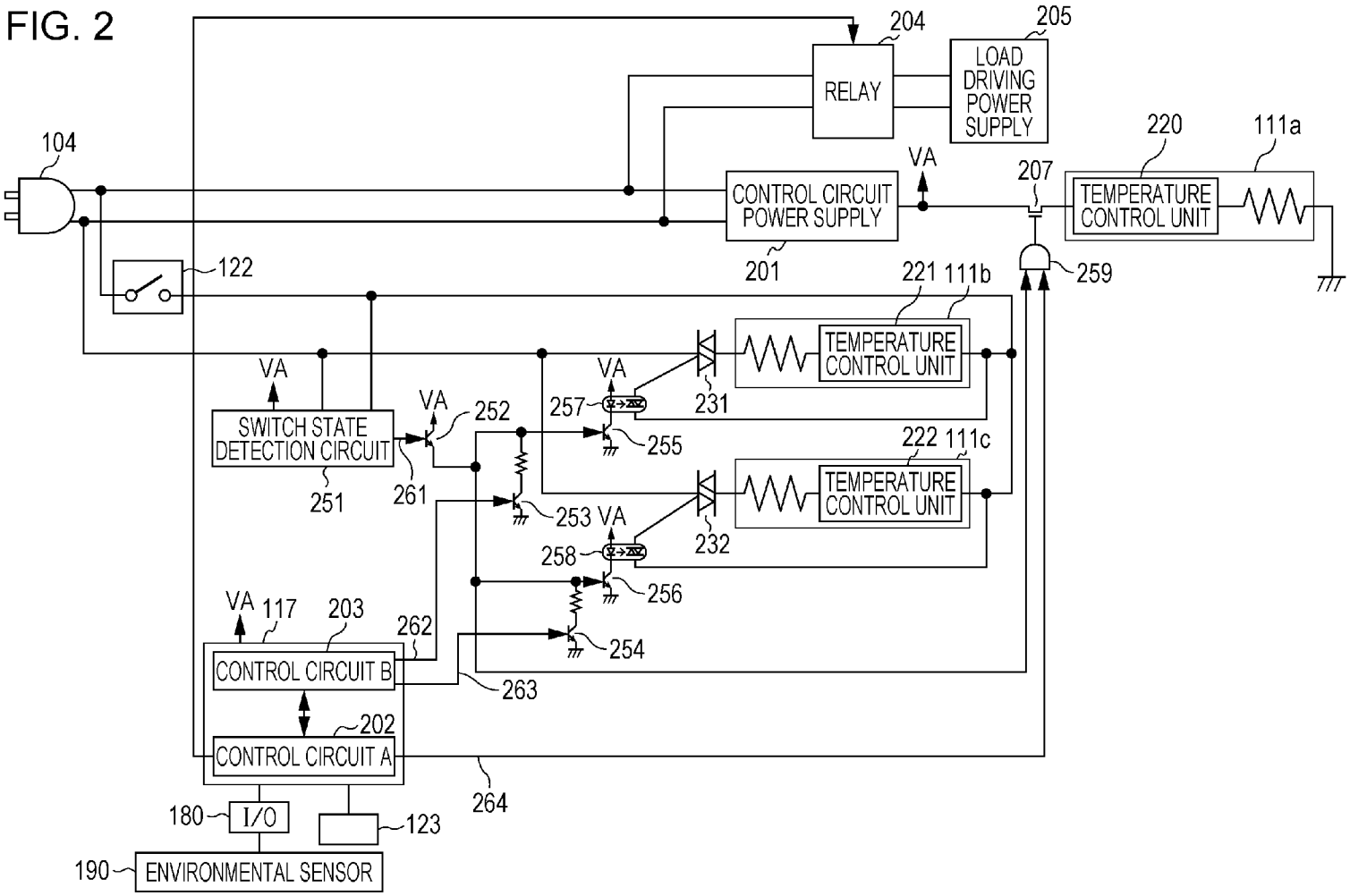
FIG. 2 is a control block diagram of an image forming apparatus according to a first embodiment of the present invention.

FIG. 2 is a control block diagram of the image forming apparatus illustrated in FIG. 1.

When the plug of the AC cord 104 of the image forming apparatus 1 is connected to a convenience receptacle, power is supplied from a commercial AC power supply to the control circuit power supply VA 201 and is then supplied from the control circuit power supply (VA) 201 to the system controller 117.

The system controller 117 includes a control circuit A 202 operating in the power save mode and the normal power mode and a control circuit B 203 operating in the normal power mode and not in the power save mode. The normal power mode is set in a standby mode where an image forming apparatus remains ready to start image forming and an image forming operation mode where the image forming apparatus performs image forming and consumes power greater than that consumed in the power save mode.

The system controller 117 controls the operation of the image forming apparatus in accordance with a control program stored in an internal Read-Only Memory (ROM). The system controller 117 includes a Random Access Memory (RAM) for storing data being processed and a nonvolatile memory for storing data at the time of power-off or in the power save mode. The system controller 117 receives a signal from the power mode change switch 123, receives signals from various sensors via an I/O port 180, and outputs a driving signal for a load, such as a motor. An environmental sensor 190 for detecting a temperature and a humidity in an environment where the image forming apparatus is located is connected to the I/O port 180.

The ON/OFF state of the relay 204 is controlled by the control circuit A 202. The relay 204 supplies power to the load driving power supply 205 in the ON state and stops the supply of power to the load driving power supply 205 in the OFF state.

The environmental switch 122 is provided at an alternating-current power supply line connected to AC heaters (the environmental heaters 111*b* and 111*c*). A switch state detection circuit (detection unit) 251 detects whether the environmental switch 122 is in the ON or OFF state. When the environmental switch 122 is in the ON state, a high-level signal is transmitted to an AND gate 259 via a transistor 252.

At a direct-current power supply line connected to the environmental heater 111*a*, a field-effect transistor (FET) 207 that is turned on or off in accordance with a signal is provided. When the control circuit A 202 outputs a signal 264 of a high level to the AND gate 259 during the ON state of the environmental switch 122, the input of the AND gate 259 becomes a high level. Accordingly, the FET 207 is turned on, and power is supplied from the control circuit power supply VA 201 to the heater 111*a*.

When the control circuit B 203 outputs a signal 262 of a high level during the ON state of the environmental switch 122, a photocoupler 257 is brought into conduction via resistors 253 and 255 and a triac 231 controls the supply of power to the heater 111*b*. When the control circuit B 203 outputs a signal 263 of a high level during the ON state of the environmental switch 122, a photocoupler 258 is brought into conduction via transistors 254 and 256 and a triac 232 controls the supply of power to the heater 111*c*.

Since the transistor 252 is turned off when the environmental switch 122 is in the OFF state, the environmental heaters 111*a*, 111*b*, and 111*c* are unpowered.

In a normal state, the control circuit A 202 always outputs the signal 264 of a high level and the control circuit B 203 always outputs signals 262 and 263 of a low level after activation. Accordingly, a user can start/stop the supply of power to the environmental heaters 111*a*, 111*b*, and 111*c* by operating the environmental switch 122.

The heaters 111*a*, 111*b*, and 111*c* include temperature control units 220, 221, and 222, respectively. These temperature control units will be described in detail below.

Figure 3:
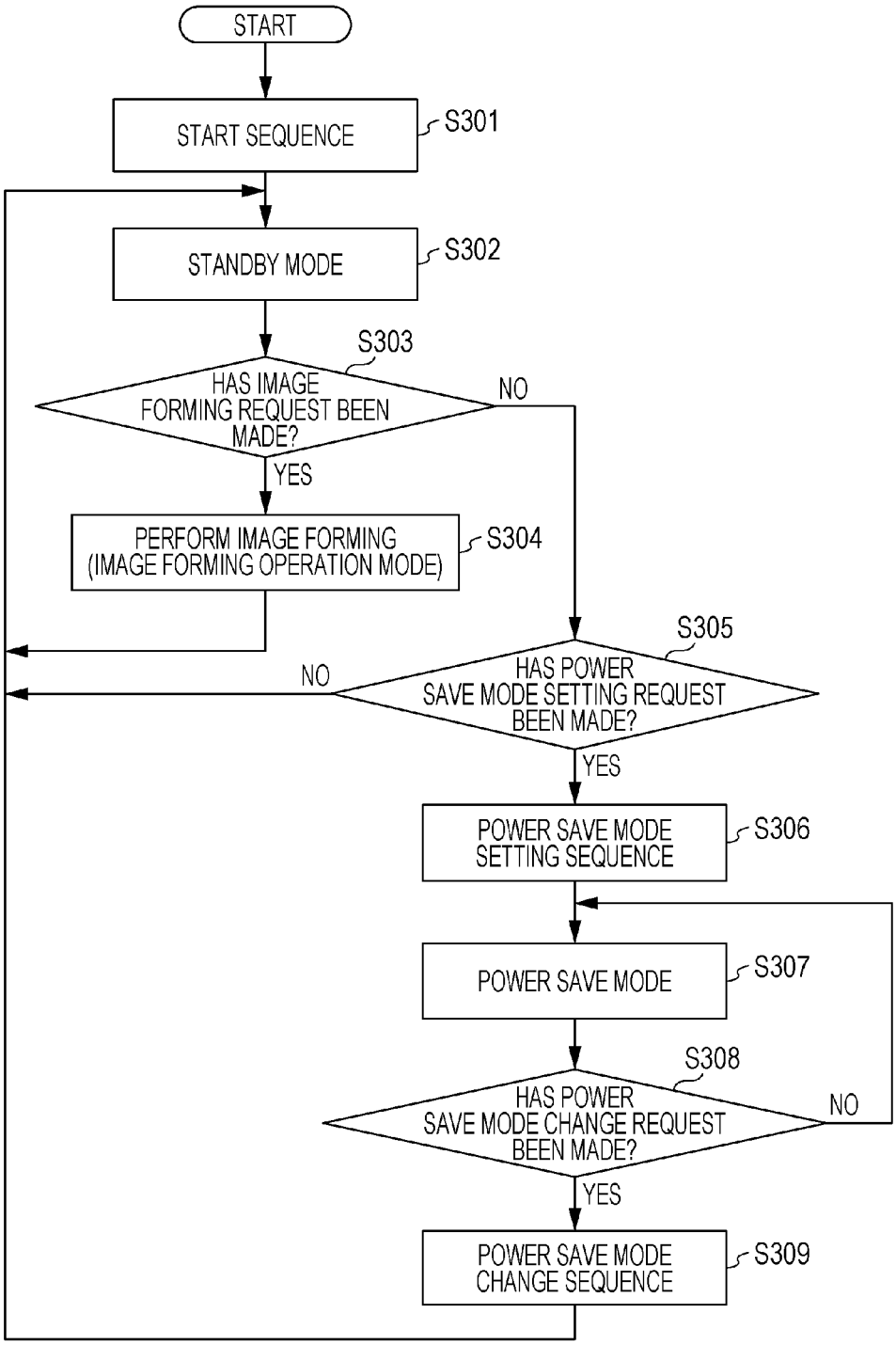
FIG. 3 is a flowchart illustrating a control process of an image forming apparatus.

Next, the operation of an image forming apparatus will be described with reference to a control flowchart illustrated in FIG. 3.

When a commercial AC power supply starts to supply power, power is supplied from the control circuit power supply VA 201 to the system controller 117 and the system controller 117 is activated. The system controller 117 performs a start sequence by activating the load driving power supply 205 and performing various pieces of processing including checking the state of an image forming apparatus and various adjustments for the image forming apparatus (S301) and brings the image forming apparatus 1 into a standby mode (S302).

Upon receiving an image forming request from an external computer or an operation unit provided in the image reading unit 102 (S303), the system controller 117 causes the image forming apparatus to perform an image forming operation (S304) and brings the image forming apparatus back into the standby mode after completion of the image forming operation (S302). In a case where there is no image forming request, upon receiving a power save mode setting request input by, for example, the press of the power mode change switch 123 (S305), the system controller 117 performs a power save mode setting sequence to be described later (S306) and brings the image forming apparatus into the power save mode (S307).

Upon receiving a power save mode change request input by, for example, the press of the power mode change switch 123 (S308), the system controller 117 performs a power save mode change sequence, described below (S309), and brings the image forming apparatus into the standby mode.

In a case where a factor in changing a mode to a power save mode, for example, the press of the power mode change switch 123, occurs, the system controller 117 deactivates the control circuit B 203 and deactivates the load driving power supply 205 by turning off the relay 204. In a case where a factor in returning a mode from the power save mode occurs, the system controller 117 activates the control circuit B 203 and activates the load driving power supply 205 by turning on the relay 204.

A mode is returned from the power save mode when the power mode change switch 123 is pressed as described above and is also returned from the power save mode, for example, when an image forming request is transmitted from an external computer. A mode is also changed to the power save mode, for example, when there is no image forming request during a predetermined period.

In the present embodiment, power can be supplied to the environmental heaters 111*a* to 111*c* only when the environmental switch 122 is in the ON state. However, in the above-described normal power mode, the system controller 117 can individually turn off the environmental heaters even when the environmental switch 122 is kept in the ON state. That is, the system controller 117 turns off the heater 111*a* by setting the signal 264 to a low level, turns off the heater 111*b* by setting the signal 262 to a high level, and turns off the heater 111*c* by setting the signal 263 to a high level. Processing for controlling turning off of each heater will be described in detail below.

A drive load (not illustrated) necessary for an image reading operation and an image forming operation, a detection element, and a control unit (not illustrated) for controlling these components are connected to the load driving power supply 205.

When the environmental switch 122 is in the OFF state, the control circuit power supply VA 201 for supplying power to the heater 111*a* does not operate and a relay 224 for supplying power to the heaters 111*b* and 111*c* is not turned on. Accordingly, when the environmental switch 122 is turned off, the supply of power to the environmental heaters 111*a*, 111*b*, and 111*c* is stopped.

The temperature conditions of the heaters 111*a* and 111*b* will be described with reference to FIGS. 4A to 4C. The operation of the heater 111*c* is the same as that of the heater 111*b*, and the description thereof will be therefore omitted.

In the present embodiment, the heaters 111*b* and 111*c* include the temperature control units 221 and 222, respectively, that are, for example, thermal reed switches. The thermal reed switch energizes the heater 111*b* when the temperature thereof is less than or equal to a predetermined temperature T2, and stops the energization of the heater 111*b* when the temperature of the temperature control unit 221 warmed by the heater 111*b* reaches a predetermined temperature T1.

When the temperature of the temperature control unit 221 reaches the temperature T2 lower than the temperature T1, the thermal reed switch energizes the heater 111*b* again. The difference between the temperatures T1 and T2 is approximately 5° C. The temperature control units 221 and 222 can control the heating conditions of the heaters 111*b* and 111*c*, respectively independently of the system controller 117.

The amount of heat generation of the heater 111*b* changes in accordance with an input voltage Vin. In a case where the resistance of a heater is Rhb, the amount of heat generation of the heater becomes $(Vin)^2/Rhb$.

Figure 4A:
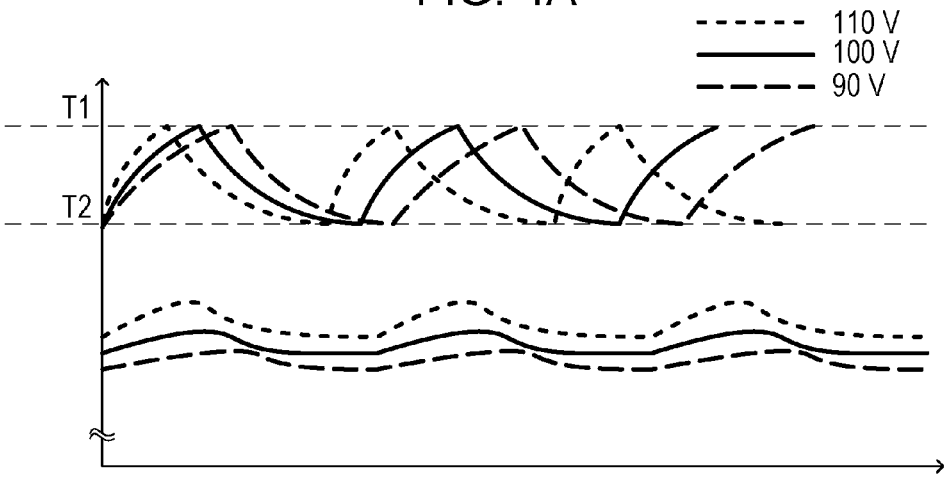
FIGS. 4A, 4B, and 4C are diagrams illustrating temperature ripples and control states of an AC heater and a DC heater.

FIG. 4A illustrates the changes in the temperature of the heater 111*b* and the changes in the ambient temperature of the heater 111*b* when a voltage input into the AC cord 104 is 90 V, 100 V, and 110 V. The changes in temperature of a heater are represented by three curves between T1 and T2, and the changes in the ambient temperature of an image reading unit warmed by the heater are represented by three curves below T2. The change in temperature at each voltage is as illustrated in the drawing.

In a case where an input voltage is 90 V, the amount of heat generation of a heater is smaller than that in the case of an input voltage of 100 V by approximately 20%. In a case where an input voltage is 110 V, the amount of heat generation of the heater is larger than that in the case of an input voltage of 100 V by approximately 20%. Since an average ambient temperature and a temperature ripple of an image reading unit change in accordance with the change in the voltage of a commercial AC power supply, stably controlling a temperature can be difficult.

The image reading unit 102 in which the heater 111*b* is provided and the sheet feed cassette 124 in which the heater 111*c* is provided are typically less susceptible to a temperature ripple and the change in average temperature. Therefore, an environmental heater whose amount of heat generation (power consumption) is substantially stable even when a rated voltage input into the image forming apparatus 1 is changed (for example, 100 V, 120 V, or 240 V) can be provided.

As previously described, a photosensitive member drum and a developer are located in the image forming unit 125 where the heater 111*a* is provided. Accordingly, in a case where a temperature unnecessarily increases, toner can agglutinate. It is therefore necessary to keep the temperature of the image forming unit at, for example, a temperature lower than 40° C. In order to perform appropriate image forming while stabilizing a toner charging amount in a developer and preventing the occurrence of condensation, the temperature of the image forming unit can be kept at approximately 35° C.

Since the control circuit power supply VA 201 that is a DC power supply (DC power source) is controlled so that it outputs a constant voltage, the output voltage of the control circuit power supply VA 201 is stable. Therefore, by supplying power from the control circuit power supply VA 201 that operates in the power save mode to the heater 111*a*, the temperature ripple of the heater 111*a* can be reduced.

For example, the control circuit power supply VA 201 used in the present embodiment can output power with accuracy of 5 V±2%, and is unsusceptible to the change in the voltage of a commercial AC power supply from which power is input into the control circuit power supply VA 201.

Figure 4B:
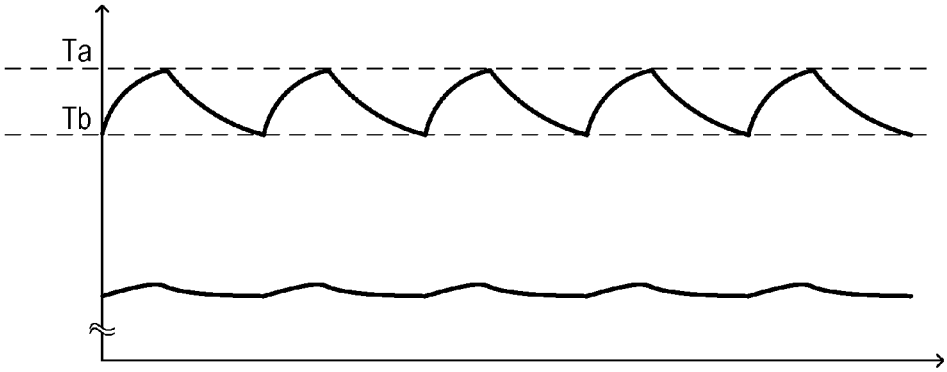
Figure 4C:
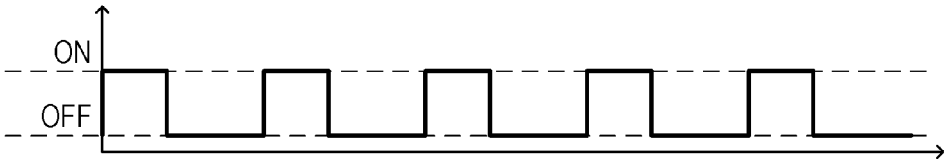

FIG. 4B illustrates the change in the temperature of the heater 111*a*. FIG. 4C illustrates the state of the FET 207 that is turned on or off by a control circuit A 202A described below.

The amount of heat generation of the heater 111*a* is $(Va)^2/Rha$, where Va represents the voltage of the control circuit power supply VA 201 and Rha represents the resistance value of the heater 111*a*. The voltage Va of the control circuit power supply VA 201 is unsusceptible to the voltage of a commercial AC power supply from which power is input into the control circuit power supply VA 201. Accordingly, the amount of heat generation stabilizes, a temperature ripple becomes small, and an average temperature can be stabilized.

The operations of the environmental heaters 111*a* to 111*c* will be described with reference to timing charts illustrated in FIGS. 5 to 7. In the following description, the low level and high level of a signal are represented by an L level and an H level, respectively.

Figure 5:
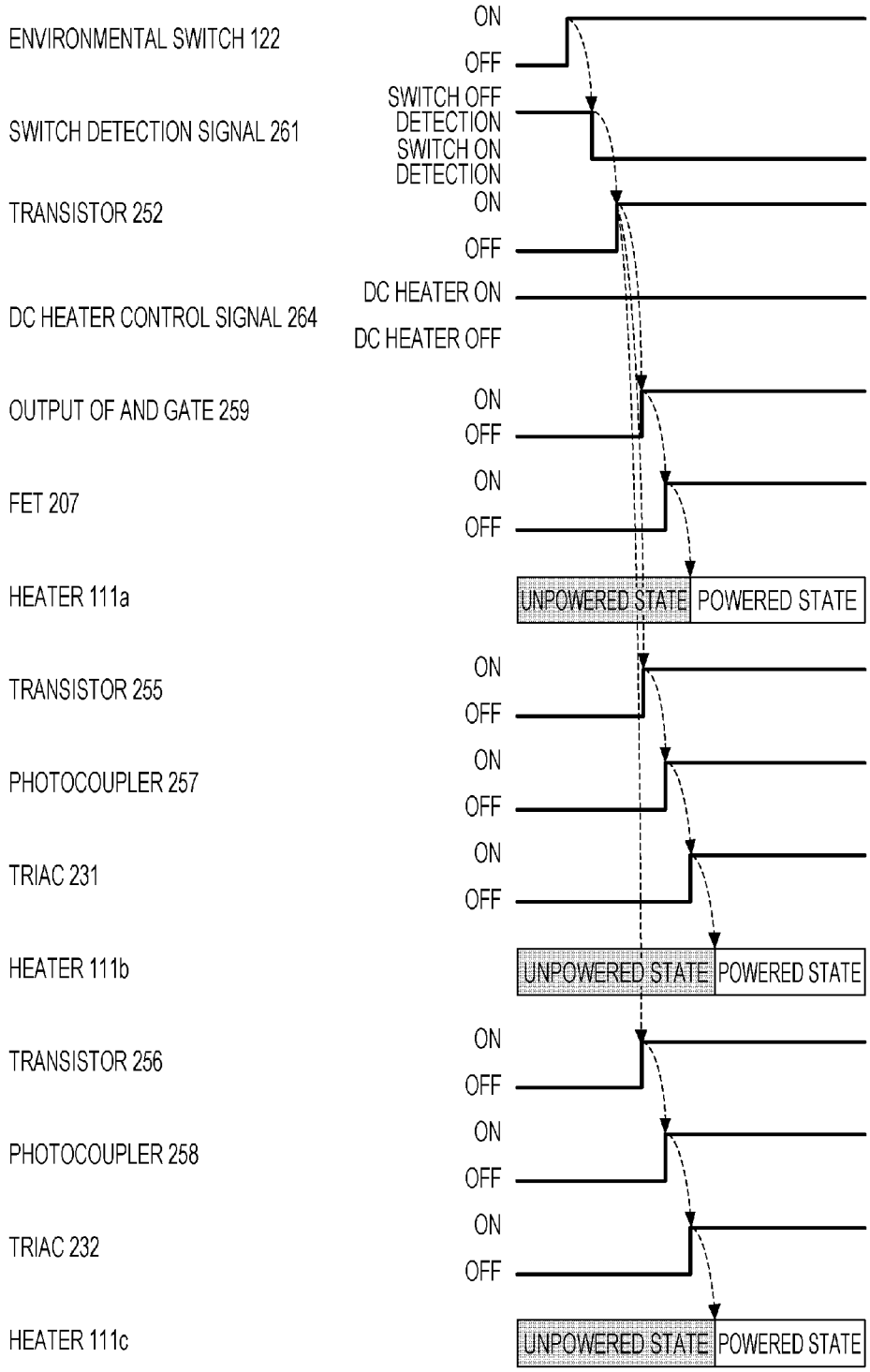

FIG. 5 is a time chart illustrating the state of each unit illustrated in FIG. 2 after the state of the environmental switch 122 has changed from the OFF state to the ON state. When the environmental switch 122 is turned on, the switch state detection circuit 251 outputs a switch detection signal 261 of the L level and the output of the transistor 252 becomes the H level. In a case where the output of the transistor 252 is the H level and the control circuit A 202 outputs the signal 264 of the H level that is a DC heater control signal, power can be supplied to the heater 111*a* after the output of the AND gate 259 has become the H level (the FET 207 has been turned on). When the output of the transistor 252 becomes the H level, the transistors 255 and 256, the photocouplers 257 and 258, and the triacs 231 and 232 are turned on. As a result, power can be supplied to the heaters 111*b* and 111*c*.

Figure 6:
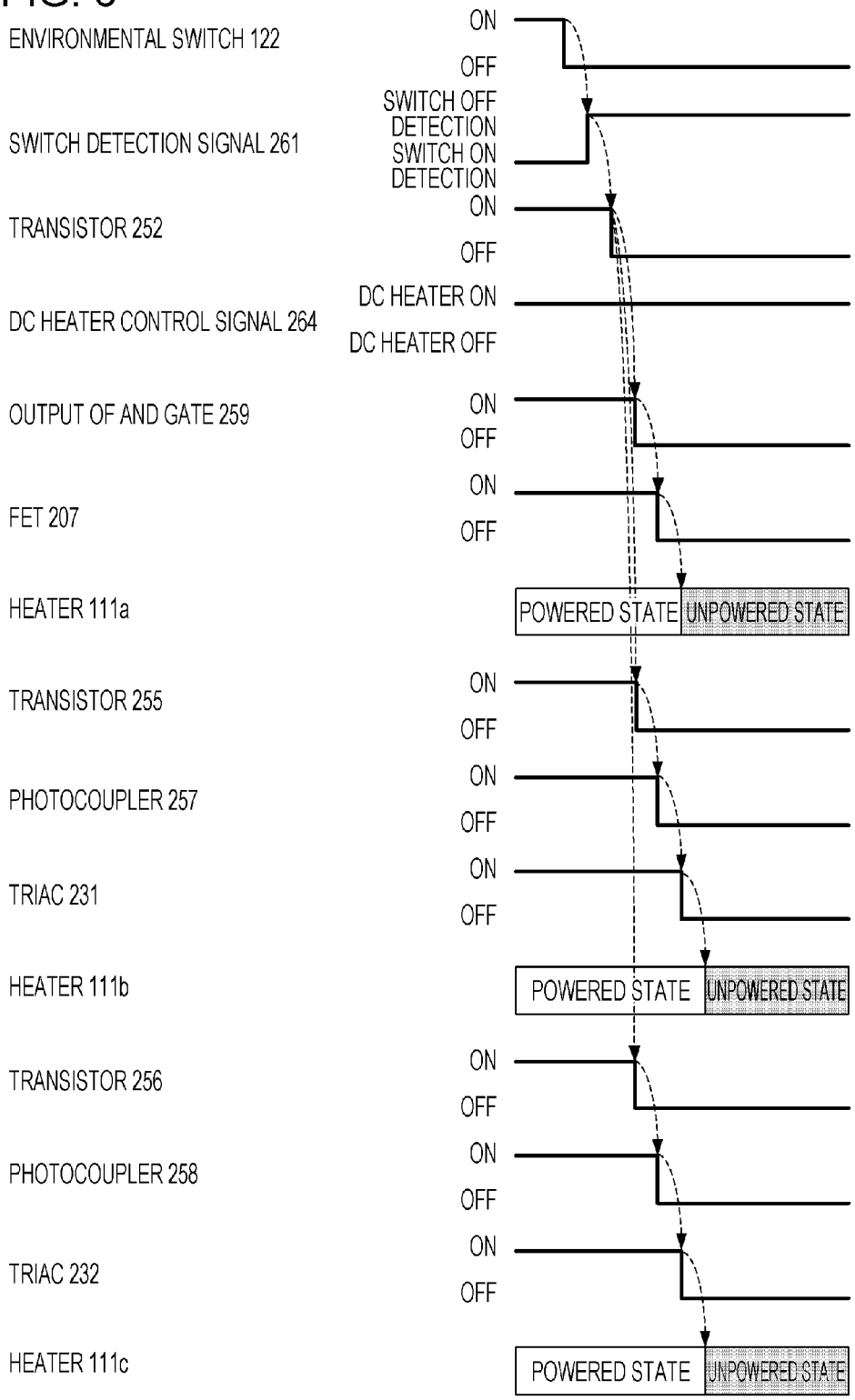
FIG. 6 is an operation timing chart after an environmental switch has been turned off.

FIG. 6 is a time chart illustrating the state of each unit illustrated in FIG. 2 after the state of the environmental switch 122 has changed from the ON state to the OFF state. When the environmental switch 122 is turned off, the switch state detection circuit 251 outputs the signal 261 of the H level that is a switch detection signal and the output of the transistor 252 becomes the L level. In a case where the output of the transistor 252 is the L level, the supply of power to the heater 111*a* is stopped after the output of the AND gate 259 has become L level (the FET 207 has been turned off). When the output of the transistor 252 becomes the L level, the transistors 255 and 256, the photocouplers 257 and 258, and the triacs 231 and 232 are turned off. As a result, the supply of power to the heaters 111*b* and 111*c* is stopped.

Figure 7:
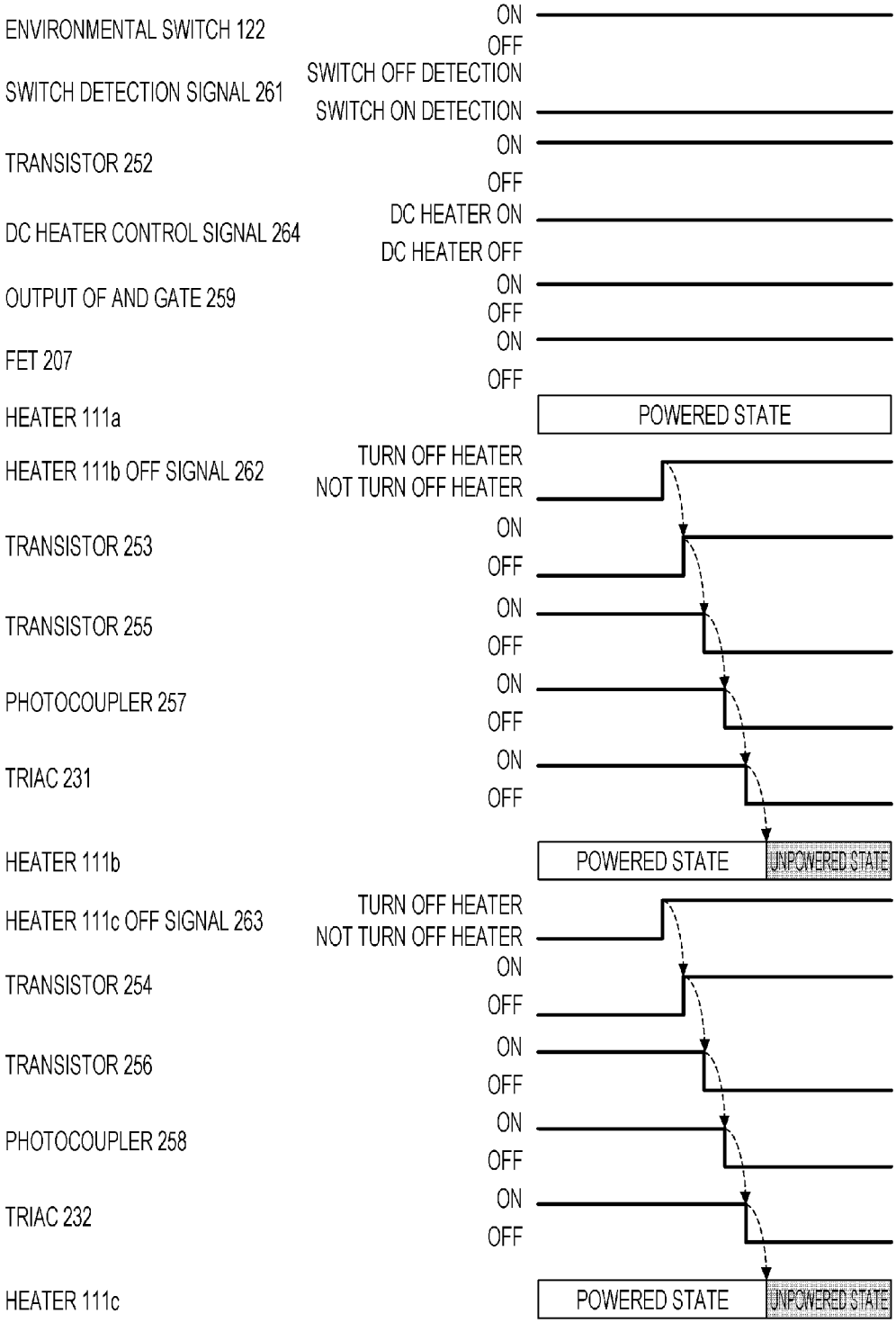
FIG. 7 is an operation timing chart when an AC heater is unpowered during the ON state of an environmental switch.

Referring to FIG. 7, when the control circuit B outputs the signal 262 of the H level in accordance with which the heater 111*b* is turned off and the signal 263 of the H level in accordance with which the heater 111*c* is turned off during the ON state of the environmental switch 122, the transistors 253 and 254 are turned on. As a result, the supply of power to the heaters 111*b* and 111*c* is stopped after the transistors 255 and 256, the photocouplers 257 and 258, and the triacs 231 and 232 have been turned off. The feeding state of the heater 111*a* is determined based on the state of the signal 264 that is a DC heater control signal output by the system controller 117. When the signal 264 is the H level, the heater 111*a* is powered. When the signal 264 is the L level, the heater 111*a* is unpowered.

Figure 8:
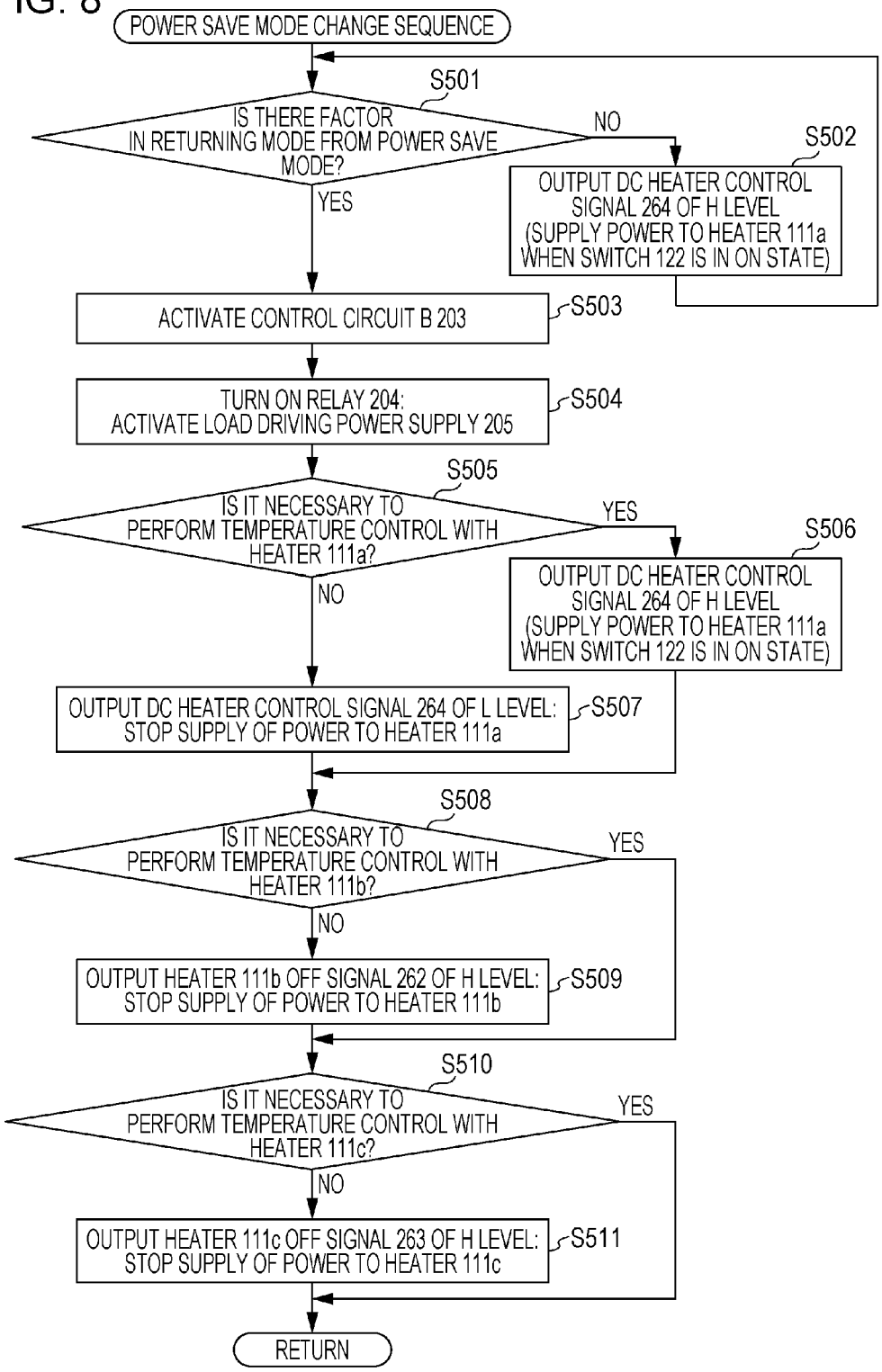
FIG. 8 is a flowchart illustrating a control process at the time of return from a power save mode.

Temperature control that the system controller 117 performs with the heaters 111*a* to 111*c* in the power save mode change sequence will be described with reference to FIG. 8.

The power save mode change sequence is performed when a factor in returning a mode from the above-described power save mode occurs. The system controller 117 determines whether a factor in returning a mode from the power save mode has occurred (S501). If it is determined that a factor in returning a mode from the above-described power save mode has not occurred, the system controller 117 outputs the signal 264 of the H level that is a DC heater control signal (S502). The process then returns to S501. In S502, in a case where the environmental switch 122 is in the ON state, the FET 207 is turned on and power is supplied from a commercial AC power supply to the heater 111*a*. Like the heaters 111*b* and 111*c*, the heater 111*a* includes the temperature control unit 220. The temperature control unit 220 has the same configuration as the temperature control units 221 and 222, except for a temperature at which the switching between energization and de-energization is performed. Temperature control is performed with the temperature control unit 220 in the heater 111*a* without the intervention of the system controller 117.

In a case where a factor in returning a mode from the power save mode occurs, the system controller 117 activates the control circuit B 203 in preparation for image forming (S503) and then outputs a signal in accordance with which the relay 204 is turned on (S504). As a result, the load driving power supply 205 is activated.

Subsequently, the system controller 117 determines whether to perform temperature control with the heater 111*a* (S505). This processing is performed based on a determination result of whether there is a situation where condensation or the like occurs and an environmental heater needs to be operated.

In a case where the ambient environment of the image forming apparatus 1 falls within a predetermined range of, for example, 20° C.±5° C. and the humidity of approximately 40%, it is not necessary to perform temperature control with the heater 111*a*. In a case where the system controller 117 determines that the image forming apparatus is under environmental conditions where it is necessary to perform temperature control with the heater 111*a*, the system controller 117 outputs the signal 264 of the H level that is a DC heater control signal (S506).

In a case where the system controller 117 determines that it is not necessary to perform temperature control with the heater 111*a*, the system controller 117 outputs the signal 264 of the L level that is a DC heater control signal (S507). As a result, the supply of power to the heater 111*a* is stopped. The system controller 117 determines whether to perform temperature control based on a temperature and a humidity detected by the environmental sensor 190.

Subsequently, the system controller 117 determines whether the image forming apparatus is under environmental conditions where it is necessary to perform temperature control with the heater 111*b* (S508). In a case where the system controller 117 determines that it is not necessary to perform temperature control with the heater 111*b*, the system controller 117 outputs the signal 262 of the H level in accordance with which a first AC heater is turned off (S509). As a result, the supply of power to the heater 111*b* is stopped.

The system controller 117 then determines whether the image forming apparatus is under environmental conditions where it is necessary to perform temperature control with the heater 111*c* (S510). In a case where the system controller 117 determines that it is not necessary to perform temperature control with the heater 111*c*, the system controller 117 outputs the signal 263 of the H level in accordance with which a second AC heater is turned off (S511). As a result, the supply of power to the heater 111*c* is stopped. The power save mode change sequence then ends.

As previously described, according to the present embodiment, starting or stopping the supply of power to a DC heater and AC heaters, which are employed as environmental heaters, can be accomplished using a common switch. This can enhance the usability of an image forming apparatus. More specifically, a DC heater is employed at a position where a temperature ripple needs to be small and AC heaters are employed at the other positions. By operating a single switch, the environmental switch 122, controlling the start/stop of supply of power to the DC heater and the AC heaters can be achieved. This enhances operability of the image forming apparatus.

In the above-described embodiment, the system controller 117 can individually turn off environmental heaters. In another embodiment, when ON/OFF control performed by the temperature control units in the environmental heaters is determined to be sufficient, the FET 207, the AND gate 259, and the transistors 253 and 254 do not have to be provided. This can result in cost reduction associated with the image forming apparatus.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-176856, filed Sep. 8, 2015 which is hereby incorporated by reference herein in its entirety.

What is claimed is:

1. An image forming apparatus, comprising:

a storage unit configured to store a recording sheet;

an image forming unit configured to form an image on the recording sheet conveyed from the storage unit;

a direct-current (DC) power source;

a first heater configured to generate heat upon application of a DC voltage from the DC power source, wherein the first heater is provided in the image forming unit;

a second heater configured to generate heat upon application of an alternating-current (AC) voltage from a commercial AC power source, wherein the second heater is provided in the storage unit;

an AC power supply line for supplying power from the commercial AC power source to the second heater;

a switch provided at the AC power supply line;

a detection unit configured to detect whether the switch is turned on or off; and a control unit configured to control power supply from the DC power source to the first heater in accordance with a detection signal from the detection unit.

2. The image forming apparatus according to claim 1, further comprising a second switch provided at the alternating-current power supply line that is turned on or off in accordance with a signal, wherein the control unit outputs a signal for turning on the second switch when the first switch is turned on.

3. The image forming apparatus according to claim 1, further comprising:

a direct-current power supply line extending from the direct current power source to the first heater; and a second switch provided at the direct-current power supply line, wherein the second switch turns on or off in accordance with a signal from the control unit.

4. The image forming apparatus according to claim 1, further comprising a heater temperature control unit configured to energized or de-energized the first heater.

5. The image forming apparatus according to claim 1, further comprising a heater temperature control unit is configured to energize or de-energize the second heater.

6. The image forming apparatus according to claim 1, further comprising:

an environmental sensor configured to detect a temperature and a humidity in an environment where the image forming apparatus is located, wherein the control unit is configured to stop supply of power to the first heater in a case where a temperature and a humidity detected by the environmental sensor fall within a predetermined range after the image forming apparatus has been returned from a power save mode during an ON state of the switch.

7. The image forming apparatus according to claim 6, wherein the control unit stops supply of power to the second heater in a case where a temperature and a humidity detected by the environmental sensor fall within the predetermined range.

8. The image forming apparatus according to claim 1, wherein the direct-current power source produces a direct-current voltage based on power supplied from the commercial AC power source in a power save mode.

9. The image forming apparatus according to claim 1, wherein in a case where the switch is turned on, DC voltage is applied from the DC power source to the first heater and AC voltage is applied from the AC power source to the second heater, and in a case where the switch is turned off, DC voltage is not applied from the DC power source to the first heater and AC voltage is not applied from the commercial AC power source to the second heater.

10. An image forming apparatus comprising:

a reading unit configured to read an image on a document;

an image forming unit configured to form an image on a recording sheet;

a direct-current (DC) power source;

a first heater configured to generate heat upon application of a direct-current voltage from the direct-current power source;

a second heater configured to generate heat upon application of an alternating-current voltage from a commercial AC power source, wherein the second heater is provided in the reading unit;

an AC power supply line for supplying power from the commercial AC power source to the second heater;

a switch provided at the AC power supply line;

a detection unit configured to detect whether the switch is turned on or off; and a control unit configured to control power supply from the DC power source to the first heater in accordance with a detection signal from the detection unit.

11. The image forming apparatus according to claim 10, further comprising a second switch provided at the alternating-current power supply line that is turned on or off in accordance with a signal, wherein the control unit outputs a signal for turning on the second switch when the first switch is turned on.

12. The image forming apparatus according to claim 10, further comprising:

a direct-current power supply line extending from the direct current power source to the first heater; and a second switch provided at the direct-current power supply line, wherein the second switch turns on or off in accordance with a signal from the control unit.

13. The image forming apparatus according to claim 10, further comprising a heater temperature control unit configured to energize or de-energize the first heater.

14. The image forming apparatus according to claim 10, further comprising a heater temperature control unit configured to energize or de-energize the second heater.

15. The image forming apparatus according to claim 10, further comprising:

an environmental sensor configured to detect a temperature and a humidity in an environment where the image forming apparatus is located, wherein the control unit is configured to stop supply of power to the first heater in a case where a temperature and a humidity detected by the environmental sensor fall within a predetermined range after the image forming apparatus has been returned from a power save mode during an ON state of the switch.

16. The image forming apparatus according to claim 15, wherein the control unit stops supply of power to the second heater in a case where a temperature and a humidity detected by the environmental sensor fall within the predetermined range.

17. The image forming apparatus according to claim 10, wherein the direct-current power source produces a direct-current voltage based on power supplied from the commercial AC power source in a power save mode.

18. The image forming apparatus according to claim 10, wherein in a case where the switch is turned on, DC voltage is applied from the DC power source to the first heater and AC voltage is applied from the AC power source to the second heater, and in a case where the switch is turned off, DC voltage is not applied from the DC power source to the first heater and AC voltage is not applied from the commercial AC power source to the second heater.

* * * * *